US006538222B2

(12) United States Patent
Hsu

(10) Patent No.: US 6,538,222 B2
(45) Date of Patent: Mar. 25, 2003

(54) PUSH BUTTON SWITCH APPARATUS AND METHOD OF ASSEMBLING THE SAME

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 10/135,666

(22) Filed: Apr. 30, 2002

(65) Prior Publication Data

US 2002/0166757 A1 Nov. 14, 2002

(30) Foreign Application Priority Data

May 10, 2001 (TW) ..... 090111131

(51) Int. Cl.[7] ..... H01H 3/72
(52) U.S. Cl. ..... 200/344; 200/341
(58) Field of Search ..... 200/341–344

(56) References Cited

U.S. PATENT DOCUMENTS 5,278,372 A * 1/1994 Takagi et al. ..... 200/344
5,329,084 A * 7/1994 Watanabe et al. ..... 200/344
5,767,464 A * 6/1998 Dyer et al. ..... 200/5 A
6,448,520 B1 * 9/2002 Inoue ..... 200/344

* cited by examiner

*Primary Examiner*—Michael Friedhofer
*Assistant Examiner*—Lisa N. Klaus
(74) *Attorney, Agent, or Firm*—Snell & Wilmer L.L.P.

(57) ABSTRACT

The present invention relates to a push button switch apparatus and a method of assembling the same. One embodiment of the present invention is a push button switch apparatus with a scissors-like structure. A bearing portion and a recess are disposed on the base plate, and a pivot bearing space is formed between the base plate and the bearing portion. One arm of the scissors-like structure has a pivot axle at its one end, and a protrusion is disposed on the pivot axle. When the push button switch apparatus is assembled, the protrusion is disposed into the recess, and the pivot axle then enters into the pivot bearing space. Then pivot axle is retained within the pivot bearing space due to walls of the recess constraining the protrusion of the pivot axle, and the arm selectively rotates along the pivot axle.

17 Claims, 10 Drawing Sheets

PUSH BUTTON SWITCH APPARATUS AND METHOD OF ASSEMBLING THE SAME

This application claims priority of Taiwan Patent Application Serial No. 090111131 filed on May 10, 2001.

FIELD OF INVENTION

The present invention relates to a push button switch apparatus and a method of assembling the same, and more particularly, to a push button switch apparatus used in a keyboard apparatus and a method of assembling the same.

BACKGROUND OF THE INVENTION

As the development of portable electronic technologies continues, engineers continually attempt to further reduce the size of such devices. In order to provide smaller keyboard devices, for example, there is a continued attempt to improve the design of push button switches used as keys in miniaturized keyboards.

FIG. 1(A) is a schematic diagram of a conventional push button switch apparatus 10. The push button switch apparatus 10 has a scissors-like structure including a key cap 11, a base plate 12, an elastically deformable actuator 13, a first arm 14, and a second arm 15. The first arm 14 and the second arm 15 are typically pivotally connected together via a pivot axle 16 so as to form the scissors-like structure of the push button switch apparatus 10. A thin film circuit board 121 is appropriately disposed on the base plate 12. A pivotal ear 123 and a bearing portion 124 are typically formed on the base plate 12.

The first arm 14 has a pivot axle 141 at its one end, and the pivot axle 141 is typically rotatably disposed in a groove 1231 of the pivotal ear 123. The second arm 15 has a pivot axle 151 at its one end, and the pivot axle 151 is slidably rotatable within a space 1241 between the bearing portion 124 and the base plate 12. The downward action of the key cap 11 causes the elastically deformable actuator 13 to downwardly press the thin film circuit board 121 to generate input signals. The scissors-like structure consists of first arm 14 and second arm 15, and functions as a holder for the deformation of the elastically deformable actuator 13 and for the up-and-down movement of the key cap 11. The thin film circuit board 121 is typically made of elastic materials, so it is regarded as a flexible layer.

Both FIG. 1(B) and FIG. 1(C) are top views of portions of elements of the push button switch apparatus 10 in FIG. 1(A) showing a method of assembling the pivot axle 141 into the groove 1231 of the pivotal ear 123. A typical scissors-like structure includes two first arms 14 connected by a shaft. Each first arm 14 typically has a U-shaped frame, as shown. Before being assembled, first arm 14 is typically pressed by a force along a direction shown as the arrowhead in FIG. 1(B), and first arm 14 is deformed to enable the pivot axle 141 to align with the groove 1231 of the pivotal ear 123. The first arm 14 is then released to make the pivot axle 141 move into the groove 1231, shown in FIG. 1(C).

Accordingly, with the design of the pivotal ear 123, the typical assembling method relies upon the deformation of the first arm 14, which results in complexity of assembly. It is therefore desirable to devise a switch structure that is assembled without the deformation of the first arm 14. Additionally, it is also desirable that a switch structure prevents the push button switch from disconnecting as the pivot axle 141 moves within the groove 1231.

SUMMARY OF THE INVENTION

In the first exemplary embodiment of the present invention, a push button switch apparatus includes a base plate and a first arm. The base plate includes a first bearing portion and a recess, wherein a pivot bearing space is formed between the base plate and the first bearing portion, and an entrance is formed on the base plate. The first arm includes a pivot axle at a first end, and the pivot axle has a protrusion. The protrusion is disposed into the recess, and the pivot axle enters into the pivot bearing space during assembly process by deforming the protrusion or the pivot axle. The walls defined by the recess constrain the pivot axle within the pivot bearing space, while the first arm selectively rotates along the pivot axle.

The second exemplary embodiment further includes a flexible layer having a second entrance on the base plate. The walls defined by the second entrance constrain the protrusion of the pivot axle and pivot axle within the pivot bearing space. One embodiment of the flexible layer is a thin film circuit board.

In the third exemplary embodiment of the present invention, the pivot axle is a short-spindle axle. By adjusting the position of the second entrance, walls defined by the second entrance constrain the protrusion of the pivot axle and pivot axle is allowed to move within the pivot bearing space.

In the fourth exemplary embodiment of the present invention, there is no protrusion on the pivot axle. The pivot axle is surrounded by the second entrance by adjusting the position of the second entrance. The pivot axle is forced into the second entrance through deformation of the shape of the second entrance. The walls defined by the second entrance constrain the pivot axle within the pivot bearing space.

In the fifth exemplary embodiment of the present invention, the pivot axle is a short-spindle axle and does not have a protrusion on the pivot axle. The walls defined by the second entrance constrain the pivot axle within the pivot bearing space.

These and other aspects of the present invention will no doubt become apparent to those of ordinary skill in the art after having read the following detailed description of the exemplary embodiments which are illustrated in the various figures and drawings.

First Embodiment

Figure 2A:
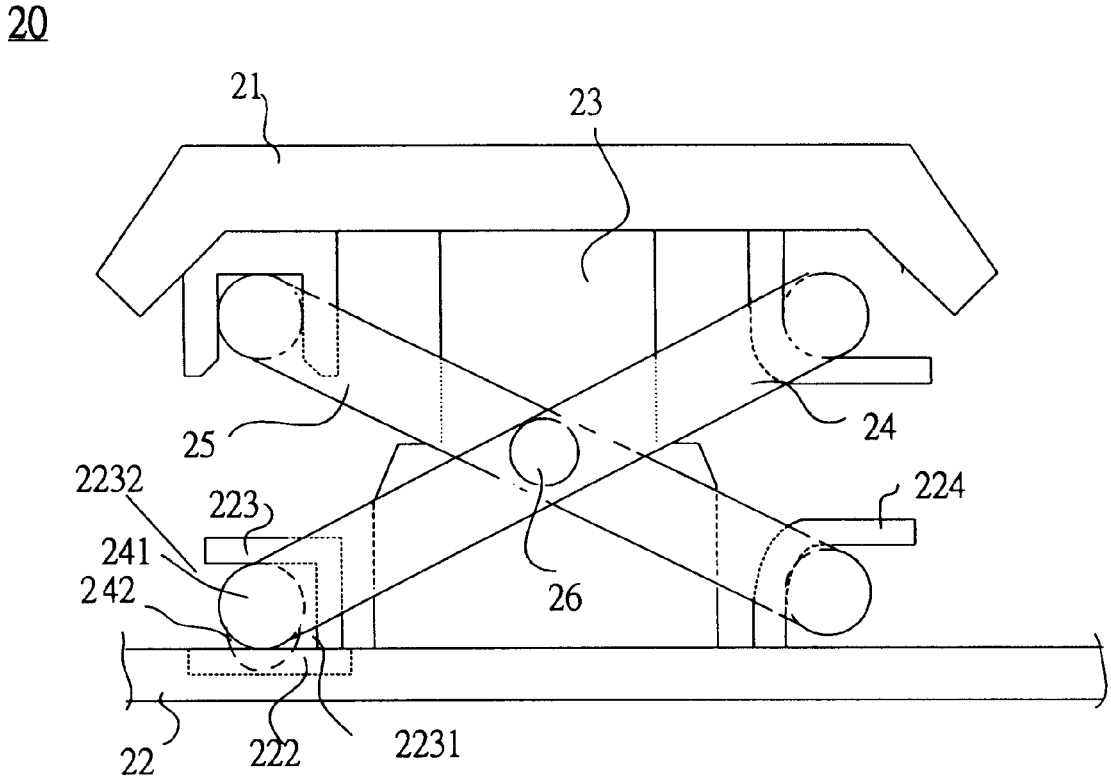
FIG. 2(A) is a side view of an exemplary push button switch apparatus according to the first embodiment.

As shown in FIG. 2(A), a push button switch apparatus 20 suitably includes a key cap 21, a base plate 22, an elastically deformable actuator 23, a first arm 24, and a second arm 25. The first arm 24 and the second arm 25 are rotatably connected together via a pivot axle 26 to constitute a scissors-like structure. A bearing portion 223 and another bearing portion 224 are formed on the base plate 22, as appropriate. The first arm 24 selectively rotates along the pivot axle 241 in response to the downward action of the key cap 21 by a user.

Figure 2B:
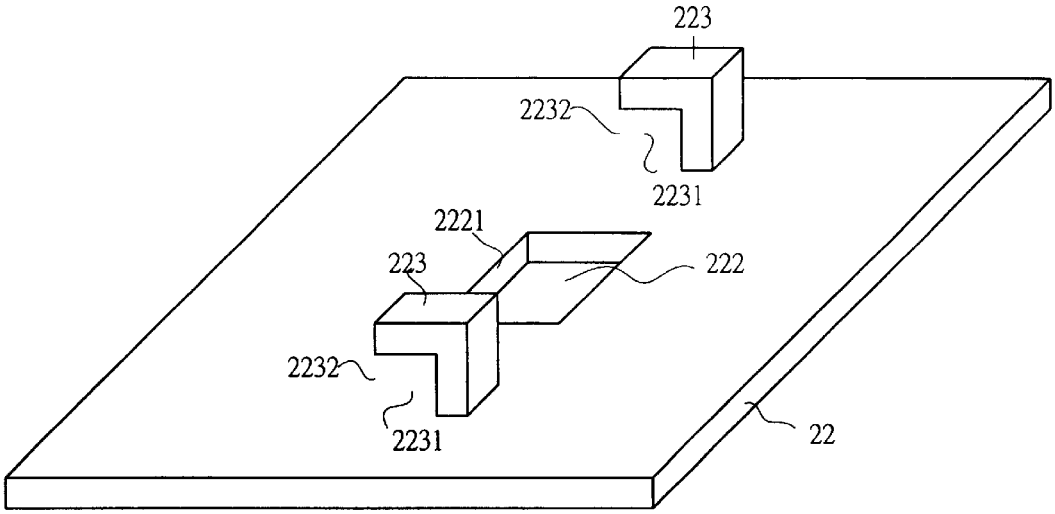
FIG. 2(B) is a schematic diagram of exemplary portions of elements of the push button switch apparatus shown in FIG. 2(A) before the first arm is assembled.
Figure 2C:
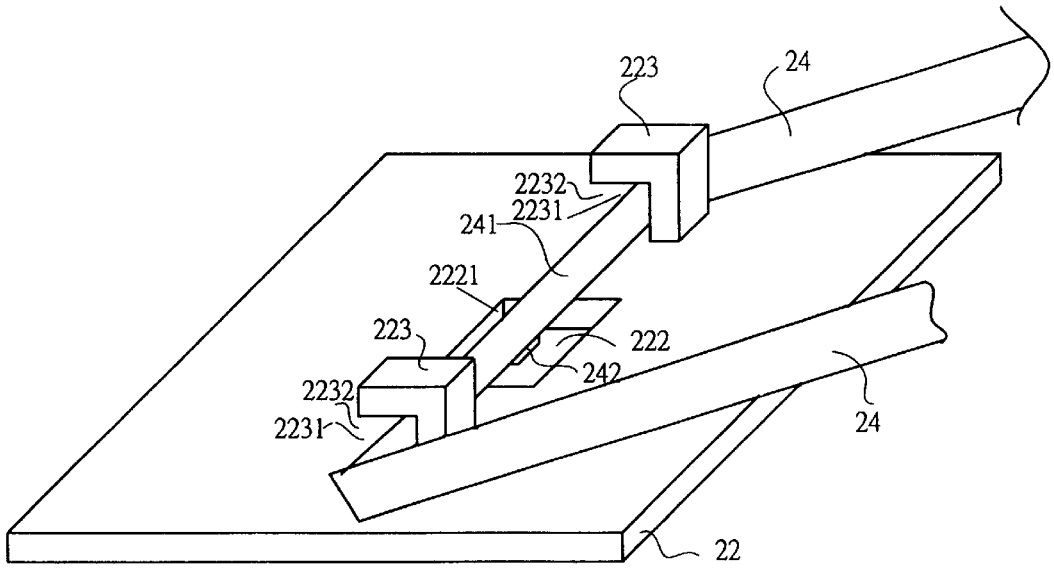
FIG. 2(C) is a schematic diagram of exemplary portions of elements of the push button switch apparatus shown in FIG. 2(A) after the first arm is assembled.

As shown in FIG. 2(B) and FIG. 2(C), the bearing portion 223 is approximately L-shaped, and a recess 222 is formed on the base plate 22. The bearing portion 223 forms a pivot bearing space 2231 and a first entrance 2232. The first arm 24 includes a pivot axle 241 at one end, and a protrusion 242 is disposed on the pivot axle 241.

During the assembly of the push button switch apparatus 20, when the protrusion 242 is an elastic element, it is pressed to deform so as to move into the recess 222. Meanwhile, the pivot axle 241 enters into the pivot bearing space 2231 through the first entrance 2232. Alternatively, as the protrusion 242 is a non-elastic element, the pivot axle 241 is bent as appropriate to deform so as to move the protrusion 242 into the recess 222. Pivot axle 241 suitably enters into the pivot bearing space 2231 through the first entrance 2232 at the same time.

Figure 2D:
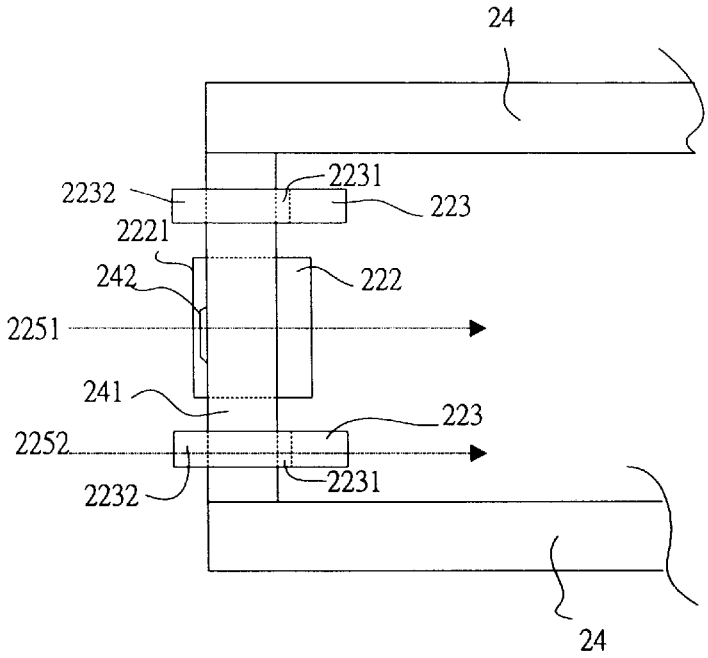
FIG. 2(D) is a top view of an exemplary push button switch apparatus shown in FIG. 2(C)

For description of the relations between the protrusion 242, the pivot axle 24, the bearing portion 223, and the recess 222, please refer to FIG. 2(C) and FIG. 2(D). As shown in FIG. 2(D), due to restriction of the bearing portion 223, the recess 222, and the protrusion 242, the pivot axle 241 is movable within the pivot bearing space 2231.

Figure 2E:
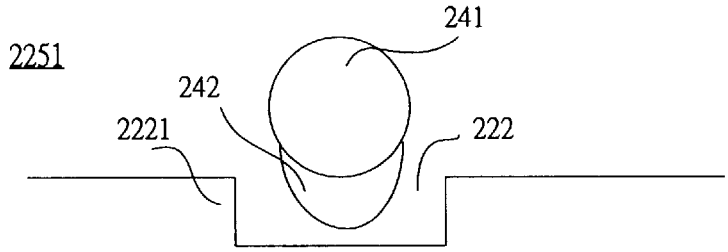
FIG. 2(E) is a cross-sectional view of an exemplary partial portion of the push button switch apparatus shown in FIG. 2(D)
Figure 2F:
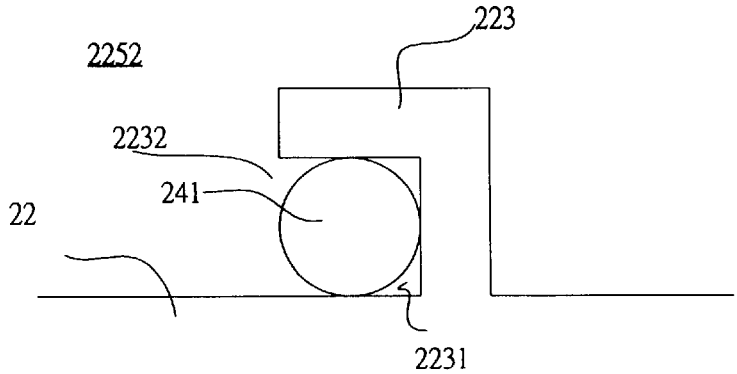
FIG. 2(F) is a cross-sectional view of another exemplary partial portion of the push button switch apparatus shown in FIG. 2(D)

As shown in FIG. 2(E) and FIG. 2(F), after entering into the pivot bearing spacer 2231, the pivot axle 241 is constrained by the bearing portion 223 from one direction shown in FIG. 2(F). Walls 2221 defining recess 222 suitably constrain the protrusion 242 of the pivot axle 241 from an opposite direction as shown in FIG. 2(E). Thus, pivot axle 241 is retained within pivot bearing space 2231, and first arm 24 can selectively rotate along pivot axle 241.

It is to be understood that the first arm 24 can be a single-arm design, or either a double-arm design as shown in FIG. 2(C), depending on various requirements of the push button switch apparatus. Pivot axle 241 may be flange-type, full-length type, or any other type of axle. The materials for forming the protrusion 242 can be different from or same as that of the pivot axle 241 such as plastic, metal, ceramic, cardboard, or the like. A plurality of protrusions 242 may be present in alternative embodiments of the present invention.

Figure 1A:
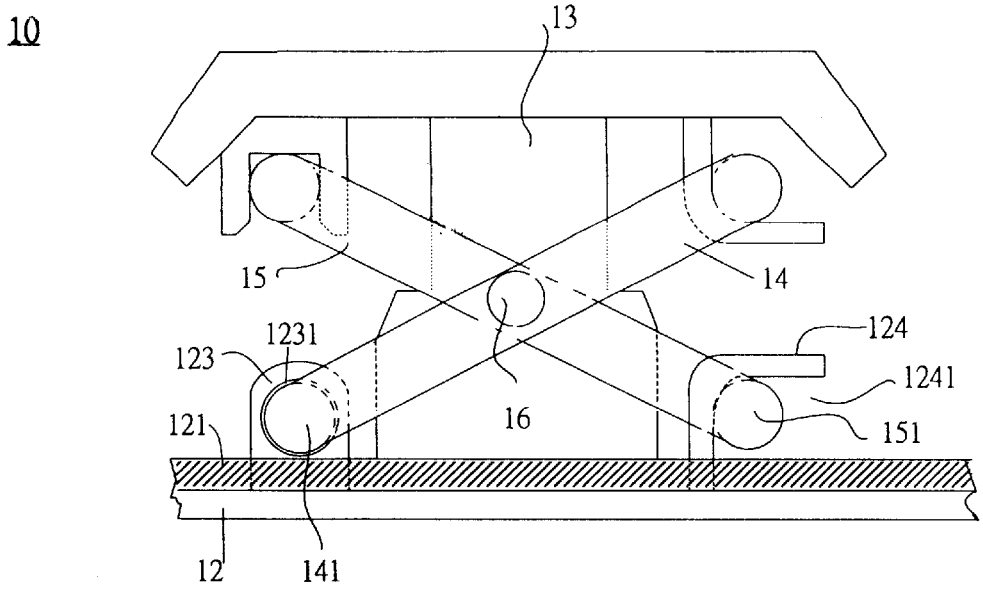
Fig.1(A)(Prior Art)
FIG. 1(A) is a schematic diagram of an exemplary push button switch apparatus according to the prior art.
Figure 1B:
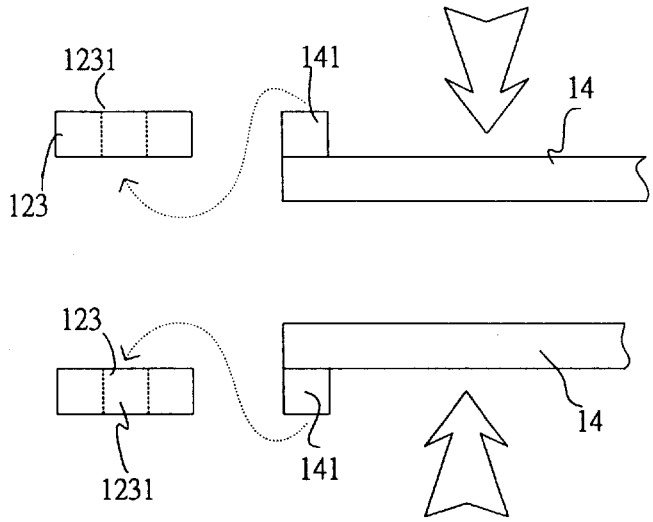
Fig.1(B)(Prior Art)
FIG. 1(B) is a schematic diagram of an exemplary push button switch apparatus shown in FIG. 1(A) before the first arm is assembled.
Figure 1C:
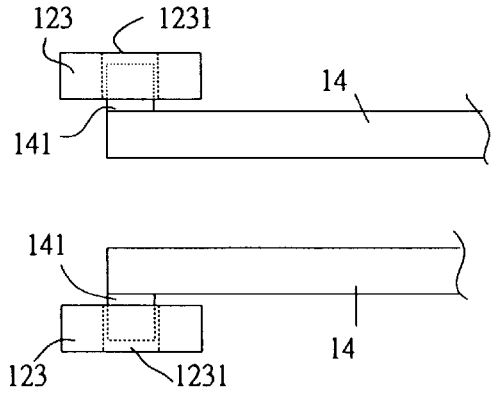
Fig.1(C)(Prior Art)
FIG. 1(C) is a schematic diagram of an exemplary push button switch apparatus shown in FIG. 1(B) after the first arm is assembled.

Functions of the other elements of the push button switch apparatus 20, such as the key cap 21, the second arm 24, the elastically deformable actuator 23, and the bearing portion 222, may be as implemented in conventional structures, such as those shown in FIG. 1(A) to FIG. 1(C).

Second Embodiment

Figure 3A:
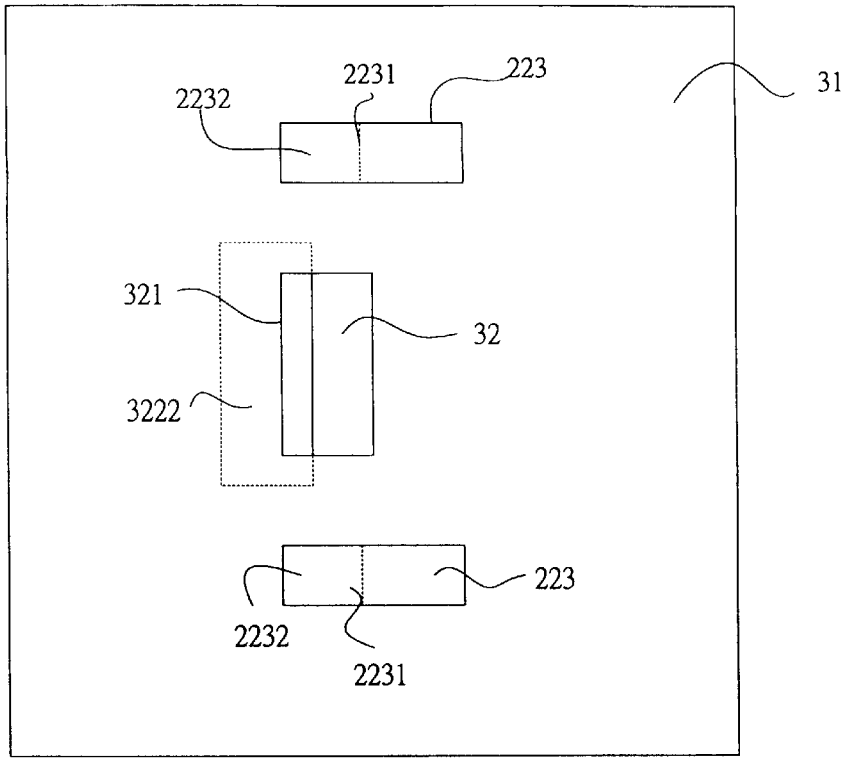
FIG. 3(A) is a schematic diagram of exemplary portions of elements of a push button switch apparatus before the first arm is assembled according to the second embodiment.

A second embodiment incorporates a flexible layer in the push button switch apparatus. In the second embodiment, as shown in FIG. 3(A), a flexible layer 31 is disposed on the base plate 22. For simplicity purposes, various equivalent elements are denoted by like numbers in the first and the second embodiments.

Figure 3B:
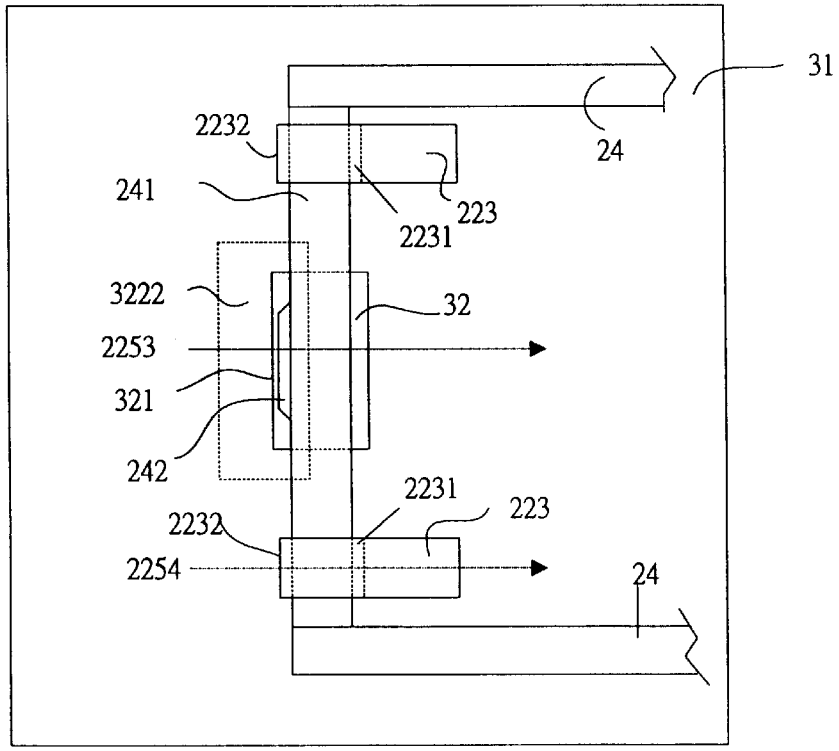
FIG. 3(B) is a schematic diagram of an exemplary push button switch apparatus after the first arm is assembled according to the second embodiment.

As shown in FIG. 3(A) and FIG. 3(B), a flexible layer 31 is disposed on the base plate 22. An embodiment of the flexible layer 31 is a thin film circuit board. The base plate 22 includes a recess 3222, and the flexible layer 31 has a second entrance 32 corresponding to the recess 3222. The recess 3222 and the second entrance 32 may be offset to each other, as appropriate.

Figure 3C:
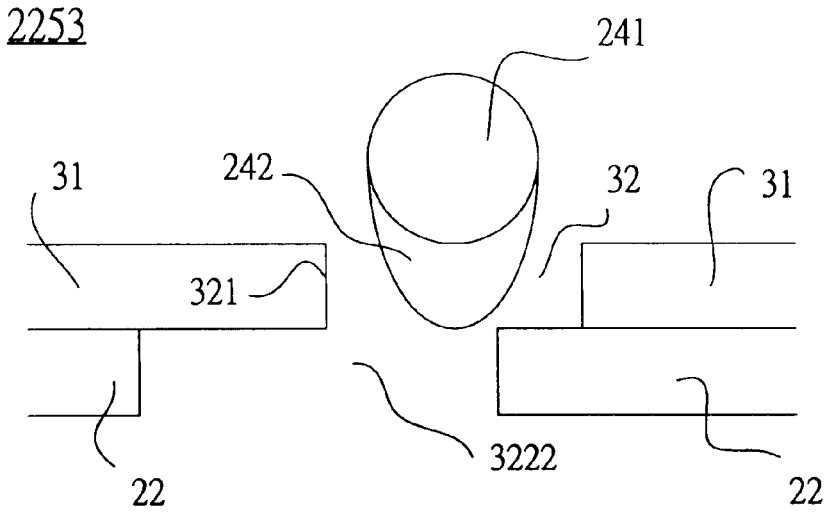
FIG. 3(C) is a cross-sectional view of an exemplary push button switch apparatus shown in FIG. 3(B)
Figure 3D:
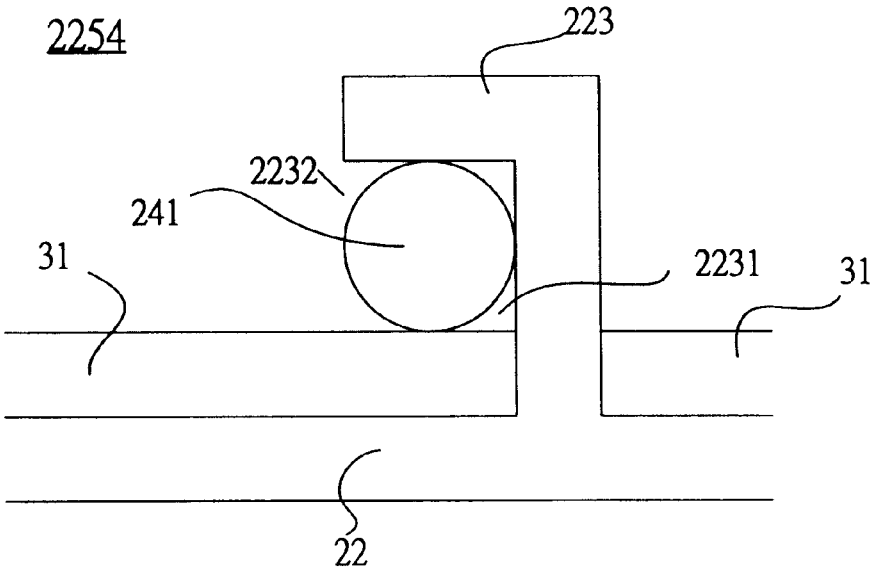
FIG. 3(D) is a cross-sectional view of an exemplary push button switch apparatus shown in FIG. 3(B)

FIG. 3(C) and FIG. 3(D) demonstrate the respective relations between the protrusion 242, the pivot axle 241, the bearing portion 223, the second entrance 32, and the recess 3222. FIG. 3(C) and FIG. 3(D) are cross-sectional views along line 2253 and line 2254 of the push button switch apparatus shown in FIG. 3(B).

To assemble first arm 24, protrusion 242 is positioned into the second entrance 32. Recess 3222 is appropriately offset to the second entrance 32 so that recess 3222 provides a deformation space for the shape of second entrance 32 of the flexible layer 31. Pivot axle 241 then enters into pivot bearing space 2231 through first entrance 2232. After pivot axle 241 is positioned into pivot bearing space 2231, walls 321 defined by the second entrance 32 of the flexible layer 31 suitably constrain the protrusion 242 from one direction shown in FIG. 3(C), and bearing portion 223 suitably constrains the pivot axle 241 from the opposite direction as shown in FIG. 3(D). Thus, pivot axle 241 is movable within the pivot bearing space 2231, as appropriate.

Although second entrance 32 of the flexible layer 31 and the recess 322 shown in FIG. 3(A) and FIG. 3(B) are both rectangular-shape, the invention is not so limited. Any different shape of the second entrance 32 of the flexible layer 31 and any different shape of the recess 322 which help the pivot axle 241 to move in the pivot bearing space 2231 are included in the scope of the present invention.

Third Exemplary Embodiment

Figure 4A:
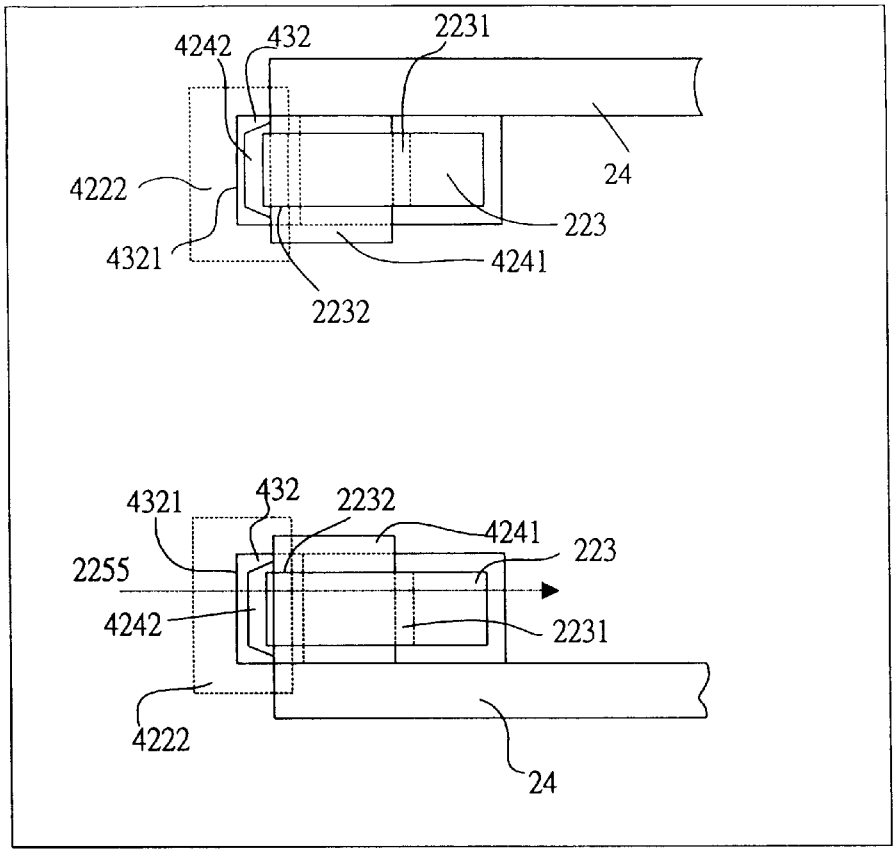
FIG. 4(A) is a schematic diagram of an exemplary push button switch apparatus according to the third embodiment.

A third exemplary embodiment includes pivot axle 241 as a full-length shaft for connecting two first arms 24 shown in FIG. 3(B). Refer now to FIG. 4(A), pivot axle 4241 of first arm 24 is a short-spindle axle, and protrusion 4242 is disposed on pivot axle 4241. In this embodiment, pivot axle 241 corresponds to the pivot axle 4241, protrusion 242 corresponds to the protrusion 4242, recess 3222 corresponds to the recess 4222, second entrance 32 corresponds to the second entrance 432, and walls defined by the second entrance 321 correspond to the walls defined by the second entrance 4321.

Figure 4B:
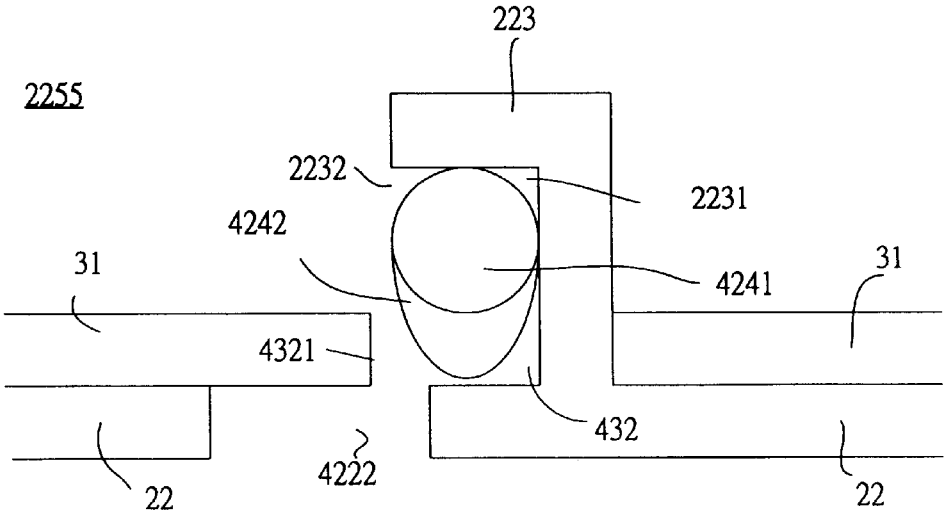
FIG. 4(B) is a cross-sectional view of an exemplary push button switch apparatus shown in FIG. 4(A)

As shown in FIG. 4(B), because recess 4222 is offset to the second entrance 432, the shape of second entrance 432 on flexible layer 31 is deformed to force the protrusion 4242 into the second entrance 432 as appropriate. Meanwhile, pivot axle 4241 suitably enters into pivot bearing space 2231 through first entrance 2232. Walls 4321 defined by second entrance 432 on the flexible layer 31 appropriately constrain the protrusion 4242 from one direction, and the bearing portion 223 constrains the pivot axle 4241 from the opposite direction as shown in FIG. 4(B). The pivot axle 4241 rotates within the pivot bearing space 2231, as appropriate.

Fourth Embodiment

Figure 5A:
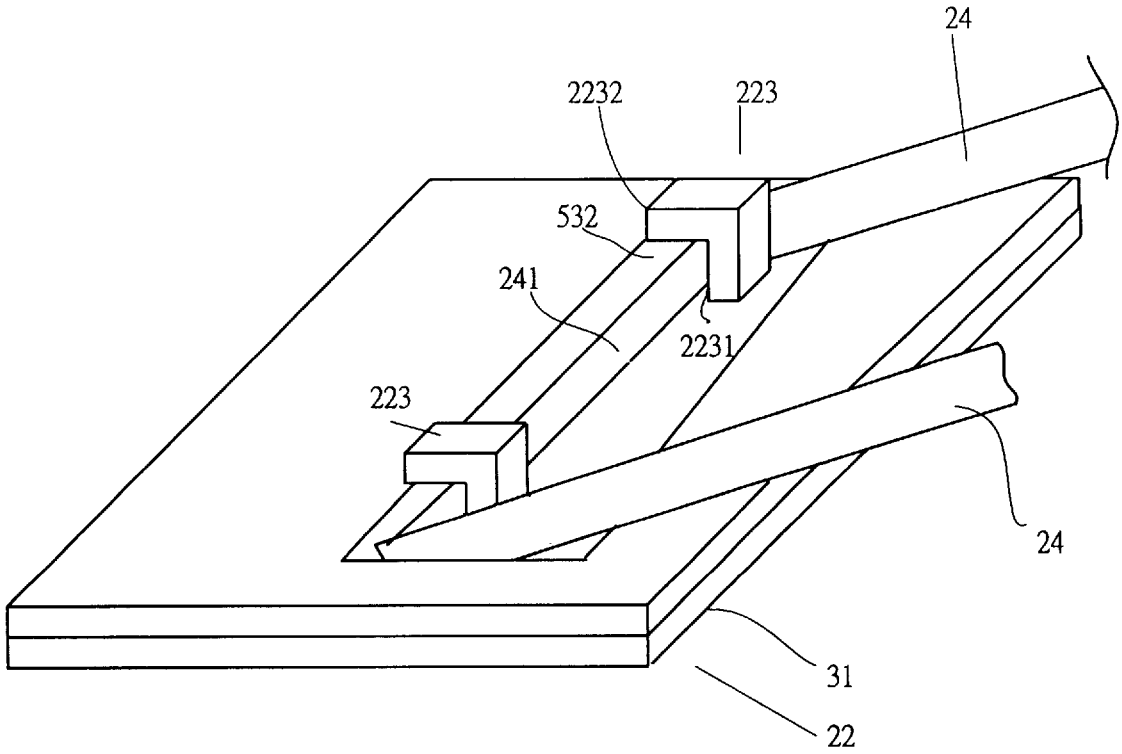
FIG. 5(A) is a schematic diagram of an exemplary push button switch apparatus according to the fourth embodiment.

Please refer to FIG. 5(A). A flexible layer 31 including a second entrance 532 may be disposed on base plate 22, as shown. Walls 5321, which are defined by second entrance 532, surround pivot axle 241 as appropriate. Pivot axle 241 may not have a protrusion in this embodiment.

Figure 5B:
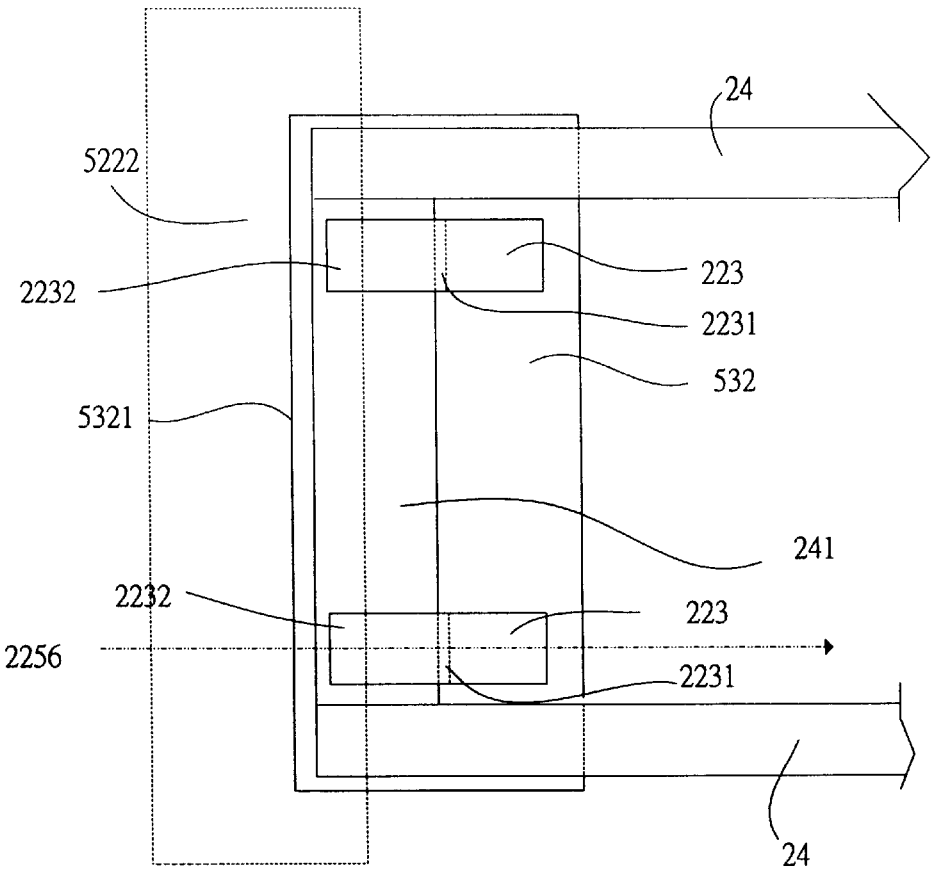
FIG. 5(B) is a top view of an exemplary push button switch apparatus shown in FIG. 5(A)
Figure 5C:
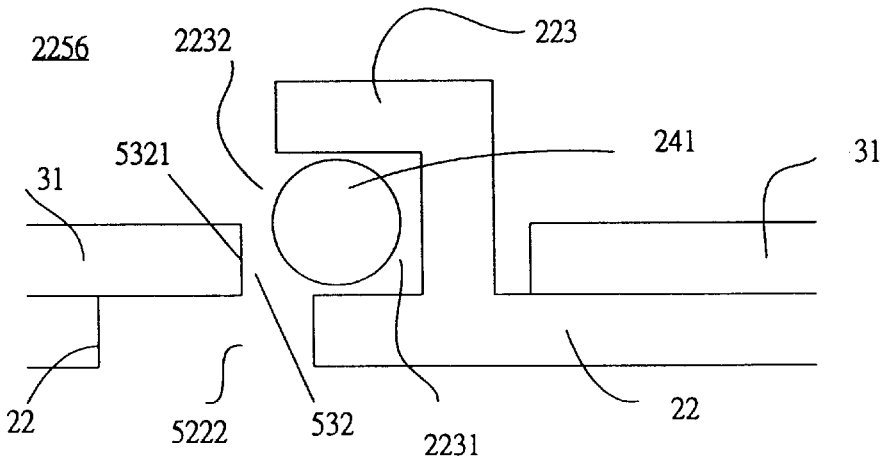
FIG. 5(C) is a cross-sectional view of an exemplary push button switch apparatus shown in FIG. 5(B)

As shown in FIG. 5(C), due to the recess 5222 being offset to the second entrance 532, the shape of the second entrance 532 is suitably deformable for moving the pivot axle 241 into the pivot bearing space 2231 through the first entrance 2232. After entering into the pivot bearing space 2231, the walls 5321 defined by the second entrance 532 constrain the pivot axle 241 from one direction. Furthermore, the pivot axle 241 may be further constrained by the bearing portion 223 from the opposite direction. Thus, the pivot axle 241 rotates within the pivot bearing space 2231.

Fifth Embodiment

Pivot axle 241 may be a full-length shaft used to connect two first arms 24 as shown in FIG. 5(B). In the embodiments, pivot axle 241 corresponds to pivot axle 6241, recess 5222 corresponds to the recess 6222, second entrance 532 corresponds to second entrance 632, and walls defined by the second entrance 5321 correspond to the walls defined by the second entrance 6321.

Figure 6A:
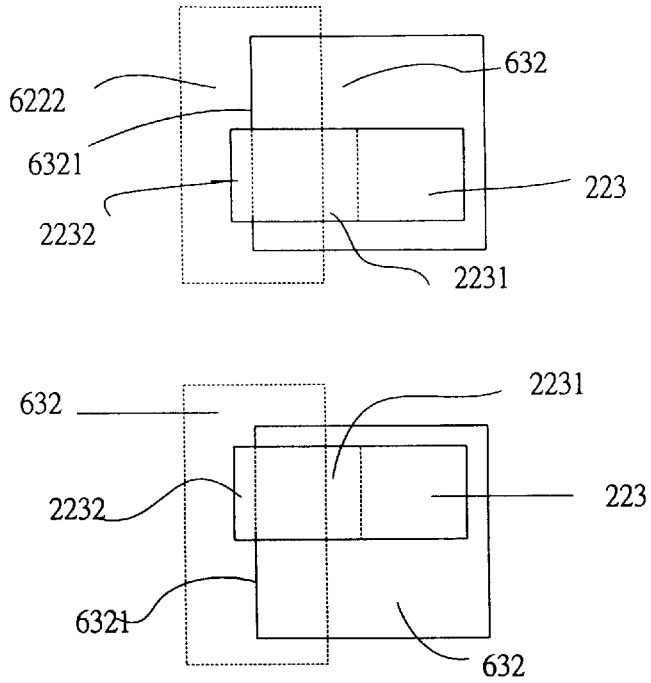
FIG. 6(A) is a schematic diagram of an exemplary push button switch apparatus according to the fifth embodiment.
Figure 6B:
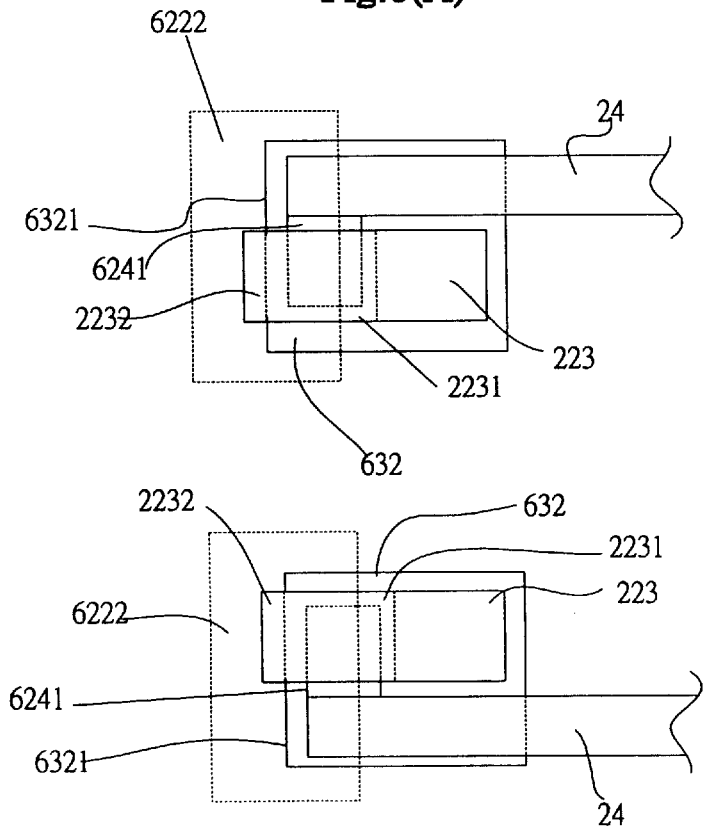
FIG. 6(B) is a schematic diagram of an exemplary push button switch apparatus according to the fifth embodiment.

As shown in FIG. 6(A) and FIG. 6(B), because the recess 6222 is offset to the second entrance 632, the shape of the second entrance 632 on the flexible layer 31 is deformable to force the pivot axle 6241 into the pivot bearing space 2231. Similar to the fourth embodiment describe above, after entering into pivot bearing space 2231, walls 6321 defined by the second entrance 632 on the flexible layer 31 constrain the pivot axle 6241 from one direction. Furthermore, the bearing portion 223 constrains the pivot axle 6241 from the opposite direction, so that the pivot axle 6241 rotates within the pivot bearing space 2231.

The foregoing discussion of exemplary embodiments is intended to explain the present invention, but not to limit the scope of the present invention. For example, a pivot axle, such as the aforementioned pivot axle 141, is used in the embodiment in the descriptions, but the invention may be readily applied to sliding pivot axles, i.e. pivot axle 151 in FIG. 1(A). Additionally, the flexible layer 31 in the fourth embodiment can be added into the first embodiment. That is, besides the recess 222 is used to constrain the protrusion 242 in the first embodiment, the pivot axle 241 can be surrounded by shape of the second entrance 32 of the flexible layer 31 so as to enhance the connection between the pivot axle 241 and the base plate 22. Numerous modifications and alterations of the device may be made while retaining the teaching of the invention. Accordingly, the above disclosure should be construed as limited only by the metes and bounds of the appended claims.

What is claimed is:

1. A push button switch apparatus comprising:

a base plate having a bearing portion and a recess, a pivot bearing space being formed between the base plate and the bearing portion; and a first arm having a pivot axle at a first end of the first arm, the pivot axle having a protrusion;

wherein the protrusion is disposed in the recess to enable the pivot axle to be retained within the pivot bearing space.

2. The push button switch apparatus of claim 1, wherein the pivot bearing space includes a first entrance and the pivot axle enters into the pivot bearing space through the first entrance.

3. The push button switch apparatus of claim 1 further comprising a key cap, the first arm further comprising a second end connected to the key cap, and the first arm selectively rotating along the pivot axle in response to up-and-down movement of the key cap.

4. The push button switch apparatus of claim 3 further comprising a second arm, the base plate further comprising a second bearing portion, and the second arm comprising two ends, wherein one end of the second arm is connected to the second bearing portion, the other end of the second arm is connected to the key cap, and the second arm is connected with the first arm to constitute a scissors-like structure.

5. The push button switch apparatus of claim 1 further comprising a flexible layer positioned on the base plate, wherein the flexible layer comprises a second entrance corresponding to the recess, and the pivot axle is disposed in the second entrance, and walls defined by the second entrance constraining the pivot axle within the pivot bearing space.

6. The push button switch apparatus of claim 1, wherein the pivot axle is slidably rotatable within the pivot bearing space.

7. A push button switch apparatus comprising:

a base plate having a first bearing portion, a pivot bearing space being formed between the base plate and the first bearing portion;

a first arm having a pivot axle at a first end of the first arm, the pivot axle having a protrusion; and a flexible layer, positioned on the base plate, having a first entrance, and the protrusion being positioned in the first entrance;

wherein walls defined by the first entrance constrain the pivot axle being movable within the pivot bearing space.

8. The push button switch apparatus of claim 7, wherein the base plate further includes a recess that provides a space for deformation of shape of the first entrance of the flexible layer.

9. The push button switch apparatus of claim 7, wherein the pivot bearing space includes a second entrance and the pivot axle enters into the pivot bearing space through the second entrance.

10. The push button switch apparatus of claim 7 further comprising a key cap, the first arm further comprising a second end connected to the key cap, and the first arm selectively rotating along the pivot axle in response to up-and-down movement of the key cap.

11. The push button switch apparatus of claim 10 further comprising a second arm having a third end and a fourth end, the base plate comprising a second bearing portion connected to the third end, the fourth end of the second arm being connected to the key cap, and the second arm being connected with the first arm to form a scissors-like structure.

12. The push button switch apparatus of claim 7, wherein the pivot axle is slidably rotatable within the pivot bearing space.

13. A push button switch apparatus comprising:

a base plate having a bearing portion and a pivot bearing space formed between the base plate and the bearing portion;

a first arm having a pivot axle at a first end; and a flexible layer, positioned on the base plate, having a first entrance, and the pivot axle being positioned in the first entrance;

wherein walls defined by the second entrance constrain the pivot axle within the pivot bearing space, and the first arm selectively rotating along the pivot axle.

14. The push button switch apparatus of claim 13, wherein the pivot bearing space includes a second entrance and the pivot axle enters into the pivot bearing space through the first entrance.

15. The push button switch apparatus of claim 13 further comprising a key cap connected to a second end of the first arm, the first arm selectively rotating along the pivot axle in response to up-and-down movement of the key cap.

16. The push button switch apparatus of claim 15 further comprising a second arm having a third end and a fourth end, the base plate further comprising a second bearing portion connected to the third end, the fourth end being connected to the key cap, and the second arm being connected with the first arm to constitute a scissors-like structure.

17. The push button switch apparatus of claim 13, wherein the pivot axle is slidably rotatable within the pivot bearing space.

* * * * *

US006538222C1

(12) EX PARTE REEXAMINATION CERTIFICATE (9869th)

United States Patent
Hsu

(10) Number: US 6,538,222 C1
(45) Certificate Issued: Oct. 11, 2013

(54) PUSH BUTTON SWITCH APPARATUS AND METHOD OF ASSEMBLING THE SAME

(75) Inventor: Chien-Shih Hsu, Taipei (TW)

(73) Assignee: Darfon Electronics Corp., Feng-Shu Tsuen, Taoyuan (TW)

Reexamination Request:
No. 90/012,750, Jan. 16, 2013

Reexamination Certificate for:

| | |
|---|---|
| Patent No.: | **6,538,222** |
| Issued: | **Mar. 25, 2003** |
| Appl. No.: | **10/135,666** |
| Filed: | **Apr. 30, 2002** |

(30) Foreign Application Priority Data

May 10, 2001 (TW) ..... 090111131

(51) Int. Cl.
*H01H 3/12* (2006.01)
*H01H 3/02* (2006.01)

(52) U.S. Cl.
USPC ..... 200/344; 200/341

(58) Field of Classification Search
None
See application file for complete search history.

(56) References Cited

To view the complete listing of prior art documents cited during the proceeding for Reexamination Control Number 90/012,750, please refer to the USPTO's public Patent Application Information Retrieval (PAIR) system under the Display References tab.

*Primary Examiner* — Nick Corsaro

(57) ABSTRACT

The present invention relates to a push button switch apparatus and a method of assembling the same. One embodiment of the present invention is a push button switch apparatus with a scissors-like structure. A bearing portion and a recess are disposed on the base plate, and a pivot bearing space is formed between the base plate and the bearing portion. One arm of the scissors-like structure has a pivot axle at its one end, and a protrusion is disposed on the pivot axle. When the push button switch apparatus is assembled, the protrusion is disposed into the recess, and the pivot axle then enters into the pivot bearing space. Then pivot axle is retained within the pivot bearing space due to walls of the recess constraining the protrusion of the pivot axle, and the arm selectively rotates along the pivot axle.

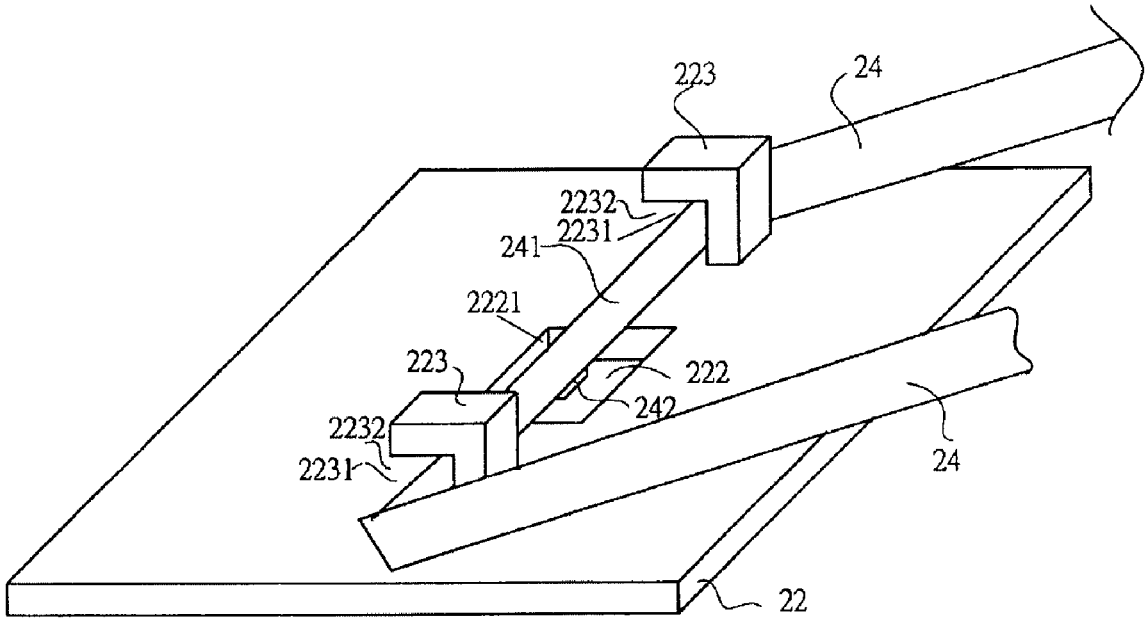

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 7, 12-14, 16 and 17 are determined to be patentable as amended.

Claims 2-5, 8-11 and 15, dependent on an amended claim, are determined to be patentable.

New claims 18-28 are added and determined to be patentable.

1. A push button switch apparatus comprising:

a base plate having [a bearing portion and] a recess *and a bearing portion located outside the recess*, a pivot bearing space being formed between the base plate and the bearing portion; and a first arm having a pivot axle at a first end of the first arm, the pivot axle having a protrusion;

wherein the protrusion is disposed in the recess to enable the pivot axle to be retained within the pivot bearing space.

6. The push button switch apparatus of claim 1 *further comprising a key cap and a second arm, and the second arm comprising a sliding end, the first arm further comprising a second end slidably connected to the key cap, the base plate further comprising a second bearing portion slidably connected to the sliding end*, wherein the pivot axle is slidably rotatable within the pivot bearing space*, and the pivot axle slides for a shorter horizontal distance than the sliding end of the second arm in response to up-and-down movement of the key cap*.

7. A push button switch apparatus comprising:

a base plate having a first bearing portion, a pivot bearing space being formed between the base plate and the first bearing portion;

a first arm having a pivot axle at a first end of the first arm, the pivot axle having a protrusion; and a flexible layer, positioned on the base plate, having a first entrance, and the protrusion being positioned in the first entrance *and the first bearing portion is located outside the first entrance*;

wherein walls defined by the first entrance constrain the pivot axle being movable within the pivot bearing space.

12. The push button switch apparatus of claim 7 *further comprising a key cap and a second arm, and the second arm comprising a sliding end, the first arm further comprising a second end slidably connected to the key cap, the base plate further comprising a second bearing portion slidably connected to the sliding end*, wherein the pivot axle is slidably rotatable within the pivot bearing space*, and the pivot axle slides for a shorter horizontal distance than the sliding end of the second arm in response to up-and-down movement of the key cap*.

13. A push button switch apparatus comprising:

a base plate having a *first* bearing portion*, a second bearing portion,* and a *first* pivot bearing space formed between the base plate and the *first* bearing portion *and a second pivot bearing space formed between the base plate and the second bearing portion*;

a first arm having a pivot axle at a first end*, the pivot axle extending from the first end through both the first and second pivot bearing spaces*; and a flexible layer, positioned on the base plate, having a first entrance *partially overlapping with both the first and second pivot bearing spaces*, and the pivot axle being positioned in the first entrance;

wherein walls defined by the [second] *first* entrance constrain the pivot axle within the pivot bearing space, and the first arm selectively rotating along the pivot axle.

14. The push button switch apparatus of claim 13, wherein the *first* pivot bearing space includes a second entrance and the pivot axle enters into the *first* pivot bearing space through the [first] *second* entrance.

16. The push button switch apparatus of claim 15 further comprising a second arm having a third end and a fourth end, the base plate further comprising a [second] *third* bearing portion connected to the third end, the fourth end being connected to the key cap, and the second arm being connected with the first arm to constitute a scissors-like structure.

17. The push button switch apparatus of claim 13 *further comprising a key cap and a second arm, and the second arm comprising a sliding end, the first arm further comprising a second end slidably connected to the key cap, the base plate further comprising a third bearing portion slidably connected to the sliding end*, wherein the pivot axle is slidably rotatable within the *first* pivot bearing space*, and the pivot axle slides for a shorter horizontal distance than the sliding end of the second arm in response to up-and-down movement of the key cap*.

*18. A push button switch apparatus comprising:*

*a base plate having a bearing portion and a recess, a pivot bearing space being formed between the base plate and the bearing portion; and*

*a first arm having a pivot axle at a first end of the first arm, the pivot axle having a protrusion;*

*wherein the protrusion is disposed in the recess but outside a space beneath the bearing portion to enable the pivot axle to be retained within the pivot bearing space.*

*19. The push button switch apparatus of claim 18 further comprising a key cap, the first arm further comprising a second end connected to the key cap, and the first arm selectively rotating along the pivot axle in response to up-and-down movement of the key cap.*

*20. The push button switch apparatus of claim 19 further comprising a second arm, the base plate further comprising a second bearing portion, and the second arm comprising two ends, wherein one end of the second arm is connected to the second bearing portion, the other end of the second arm is connected to the key cap, and the second arm is connected with the first arm to constitute a scissors-like structure.*

*21. The push button switch apparatus of claim 18 further comprising a key cap and a second arm, and the second arm comprising a sliding end, the first arm further comprising a second end slidably connected to the key cap, the base plate further comprising a second bearing portion slidably connected to the sliding end, wherein the pivot axle is slidably rotatable within the pivot bearing space, and the pivot axle slides for a shorter horizontal distance than the sliding end of the second arm in response to up-and-down movement of the key cap.*

*22. A push button switch apparatus comprising:*

*a base plate having at least two bearing portions and a recess, wherein the recess is located between the two bearing portions, and a pivot bearing space being formed between the base plate and each bearing portion; and*

*a first arm having a pivot axle at a first end of the first arm, the pivot axle having a protrusion;*

*wherein the protrusion is disposed in the recess to enable the pivot axle to be retained within the pivot bearing space.*

*23. The push button switch apparatus of claim 22, wherein the recess has a wall which is located between the two bearing portions, and wherein the protrusion is constrained by the wall to enable the pivot axle to be retained within the pivot bearing space.*

*24. The push button switch apparatus of claim 22 further comprising a key cap, the first arm further comprising a second end connected to the key cap, and the first arm selectively rotating along the pivot axle in response to up-and-down movement of the key cap.*

*25. The push button switch apparatus of claim 24 further comprising a second arm, the base plate further comprising a third bearing portion, and the second arm comprising two ends, wherein one end of the second arm is connected to the third bearing portion, the other end of the second arm is connected to the key cap, and the second arm is connected with the first arm to constitute a scissors-like structure.*

*26. The push button switch apparatus of claim 22 further comprising a key cap and a second arm, and the second arm comprising a sliding end, the first arm further comprising a second end slidably connected to the key cap, the base plate further comprising a third bearing portion slidably connected to the sliding end, wherein the pivot axle is slidably rotatable within the pivot bearing space, and the pivot axle slides for a shorter horizontal distance than the sliding end of the second arm in response to up-and-down movement of the key cap.*

*27. A push button switch apparatus comprising:*

*a base plate having at least two bearing portions, a pivot bearing space being formed between the base plate and each bearing portion;*

*a first arm having a pivot axle at a first end of the first arm, the pivot axle having a protrusion; and*

*a flexible layer, positioned on the base plate, having a first entrance located between the two bearing portions, and the protrusion being positioned in the first entrance;*

*wherein walls defined by the first entrance constrain the pivot axle being movable within the pivot bearing space.*

*28. A push button switch apparatus comprising:*

*a base plate having at least two bearing portions and a pivot bearing space formed between the base plate and each bearing portion;*

*a first arm having a pivot axle at a first end; and*

*a flexible layer, positioned on the base plate, having a first entrance located between the two bearing portions, and the pivot axle being positioned in the first entrance;*

*wherein walls defined by the first entrance constrain the pivot axle within the pivot bearing space, and the first arm selectively rotating along the pivot axle.*

* * * * *